US007602113B2

(12) United States Patent
Tsai et al.

(10) Patent No.: US 7,602,113 B2
(45) Date of Patent: Oct. 13, 2009

(54) LIGHT SOURCE, FLUORESCENT LAMP AND BACKLIGHT MODULE UTILIZING THE SAME

(75) Inventors: Yi-Shiuan Tsai, Kaohsiung (TW); Yi-Jing Wang, Hualien (TW); Yi-Chun Lin, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 591 days.

(21) Appl. No.: 11/142,652

(22) Filed: Jun. 1, 2005

(65) Prior Publication Data

US 2006/0152131 A1 Jul. 13, 2006

(30) Foreign Application Priority Data

Jan. 13, 2005 (TW) ..... 94100993 A

(51) Int. Cl.

| | |
|---|---|
| ***H01J 11/02*** | (2006.01) |
| ***H01J 17/18*** | (2006.01) |
| *H01J 1/62* | (2006.01) |
| *H01J 63/04* | (2006.01) |

(52) U.S. Cl. ..... 313/491; 313/534; 313/607; 313/634; 315/56

(58) Field of Classification Search ..... 313/495–497; 445/24–25

See application file for complete search history.

(56) References Cited

U.S. PATENT DOCUMENTS

| | | | | |
|---|---|---|---|---|
| 5,304,893 | A * | 4/1994 | Nieda | 313/631 |
| 6,674,250 | B2 * | 1/2004 | Cho et al. | 315/291 |
| 6,963,164 | B2 * | 11/2005 | Chow et al. | 313/402 |
| 2005/0269924 | A1 * | 12/2005 | Kao et al. | 313/110 |

FOREIGN PATENT DOCUMENTS

| | | | |
|---|---|---|---|
| JP | 56061732 | A * | 5/1981 |
| JP | 8190891 | | 7/1996 |
| JP | 2002025499 | | 1/2002 |

OTHER PUBLICATIONS

Yasuo, JP 2002-025499, Jan. 2002, (machine translation).*
Kadoma et al., Japanese Patent 56061732, May 1981, english abstract and constitution only.*
TW Office Action mailed Mar. 3, 2007.
TW Office Action mailed May 13, 2008.

* cited by examiner

*Primary Examiner*—Sikha Roy
*Assistant Examiner*—Tracie Green
(74) *Attorney, Agent, or Firm*—Thomas, Kayden, Horstemeyer & Risley

(57) ABSTRACT

Light source and backlight module utilizing the same. The light source includes a hollow glass tube and an electrode disposed therein. The electrode comprises a bent surface, increasing surface area, thereby increasing light emission efficiency and reducing temperature.

20 Claims, 4 Drawing Sheets

LIGHT SOURCE, FLUORESCENT LAMP AND BACKLIGHT MODULE UTILIZING THE SAME

BACKGROUND

The present invention is generally related to a backlight module, and more particularly, to a light source, a fluorescent lamp and a backlight module utilizing the same.

Currently, the main light source of a conventional backlight module is cold cathode fluorescent lamps (CCFLs). As shown in FIG. 1A, a conventional CCFL 10' comprises a hollow glass tube 11', electrodes 12*a*' and 12*b*', and wires 13*a*' and 13*b*'. The electrodes 12*a*' and 12*b*' and the wires 13*a*' and 13*b*' are disposed at each end of the hollow glass tube 11', respectively. The hollow glass tube 11' contains mercury (Hg), phosphor, and inert gas (not shown). The electrodes 12*a*' and 12*b*' are cylindrical and made of metal. When a high voltage is applied to the electrode 12*a*' of the hollow glass tube, electrons are emitted from the electrode 12*b*' at low voltage end to the electrode 12*a*' at high voltage end. The electrons are accelerated due to the high voltage, causing collisions with the Hg atoms in the hollow glass tube 11'. After collision with the Hg atoms, the Hg atoms quickly return to their stable state, and excess energy produces ultraviolet (UV) light. The UV light contacts or impacts the phosphors to produce visible light.

When the electrons are emitted from the low voltage end, and the gaseous ions collide at the electrode 12*a*' at high voltage, however, a portion of gaseous ions 16' are sputtered on the surface 15' of the electrode 12*a*', as shown in FIG. 1B. The sputtering area of gaseous ions 16 on the electrode surface 15' is gradually increased with long-term use. When the surface 15' is completely covered by the gaseous ions 16, it is the end of the lifetime of the lamp.

Thus, if gaseous ion sputtering time is shorter, the lifetime of the lam is longer. That is, if the surface of the electrode is larger, and sputtering area is increased, the temperature at the end of the electrode can be reduced accordingly.

Additionally, regarding of light emission efficiency of the lamp, the larger the surface area of the electrode for emitting electrons, the more electrons are released, producing higher intensity of UV light for better light emission efficiency.

In the conventional lamp, the length L' of the electrode is increased to increase surface area for gaseous ion sputtering. As shown in FIG. 1A, however, although the surface area is increased, the total length and weight of the hollow glass tube are increased accordingly. Due to compact size demands, the conventional lamp is unsatisfactory. Moreover, if the length is increased, effective illumination region E' is also reduced, and thus, light emission efficiency is still insufficient.

SUMMARY

Embodiments of the present invention provide a light source to eliminate the shortcomings described by varying the shape of the electrode to increase surface area and light emission efficiency of the lamp while reducing electrode temperature.

Also provided is a light source comprising a hollow glass tube and an electrode disposed therein. The electrode comprises a bent surface.

The bent surface is substantially wave-shaped, substantially concavo-convex shaped, substantially bellow-shaped, substantially castellated-shaped, substantially ragged-shaped or substantially tooth-shaped.

The bent surface of the electrode comprises a plurality of connected protrusions, each of the connected protrusions comprising a tip-end.

In another embodiment, the bent surface of the electrode comprises a plurality of connected curved portions.

The electrode is substantially cup-shaped with a closed portion opposite to the central portion of the hollow glass tube. The light source further comprises a wire, electrically connected to the closed portion of the electrode and the hollow glass tube.

The cross-section of the electrode is substantially non-circular.

In an embodiment of the present invention, the light source further comprises a negative electrode having a bent surface, disposed opposing to the electrode.

The electrode is formed by metal-powder metallurgy or sheet-metal work.

Embodiments of the present invention further provide a backlight module, comprising a frame, a reflective sheet, and a lamp. The reflective sheet is disposed in the frame. The lamp is disposed over the reflective sheet, comprising a hollow glass tube and an electrode. The electrode is disposed in the hollow glass tube and comprises a bent surface. The backlight module further comprises at least one optical film, disposed over the lamp.

Embodiments of the present invention further provide a fluorescent lamp comprising a hollow glass tube, a first electrode, a second electrode, and two wires. The hollow glass tube comprises inert gas and mercury (Hg) therein. The first electrode is disposed at one end of the hollow glass tube, comprising a first bent surface. The second electrode is disposed at the other end of the hollow glass tube, comprising a second bent surface. The wires electrically connected to the hollow glass tube, the first electrode, and the second electrode, are disposed at each end of the hollow glass tube, respectively.

BRIEF DESCRIPTION OF THE DRAWINGS

An exemplary embodiments of the present invention can be more fully understood by reading the subsequent detailed description in conjunction with the examples and references made to the accompanying drawings, wherein.

DETAILED DESCRIPTION

Figure 1A:
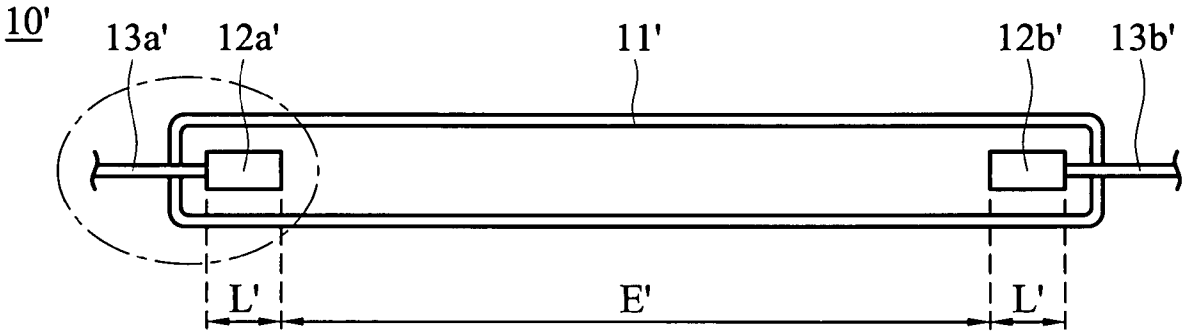
FIG. 1A (RELATED ART)
FIG. 1A is a cross-section of a conventional light source.
Figure 1B:
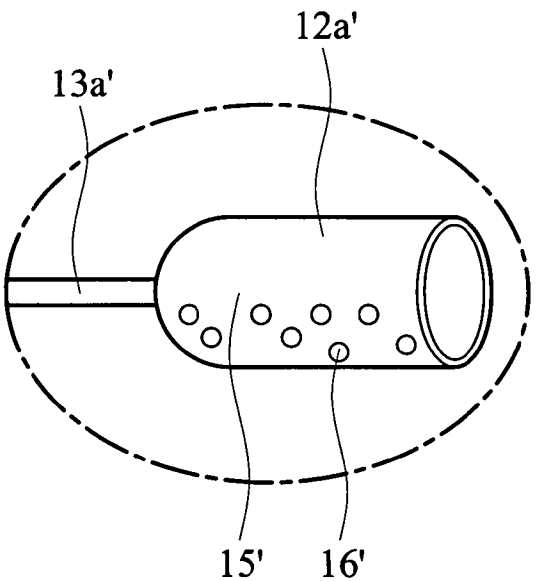
FIG. 1B (RELATED ART)
FIG. 1B is a local enlarged view of a cylindrical electrode of a conventional light source.
Figure 2:
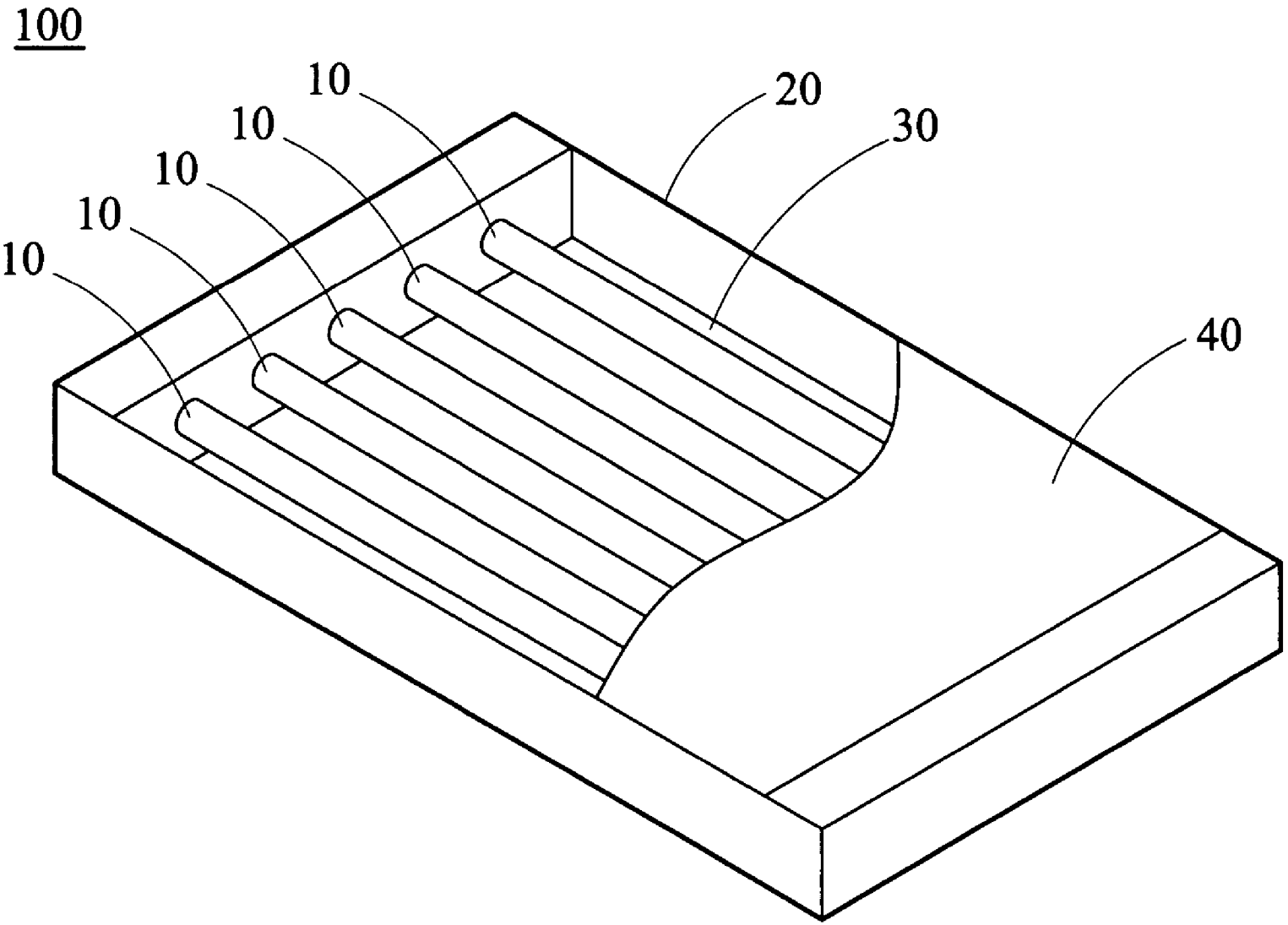
FIG. 2 is a perspective view of a backlight module of an embodiment of the present invention.

FIG. 2 is a perspective view of a backlight module 100 of an embodiment of the present invention. The backlight module 100 comprises a frame 20, a reflective sheet 30, a diffusion sheet 40, and a light source 10. The reflective sheet 30 is disposed in the frame 20. The backlight module 100 further comprises at least one optical film, disposed over the light source 10. The light source 10 is disposed over the reflective sheet 30. The light source 10 comprises a lamp such as a cold cathode fluorescent lamp. A principal aim of the present invention is to improve light emission efficiency of the backlight module 100, and thus, description of other elements in the backlight module is omitted.

Figure 3A:
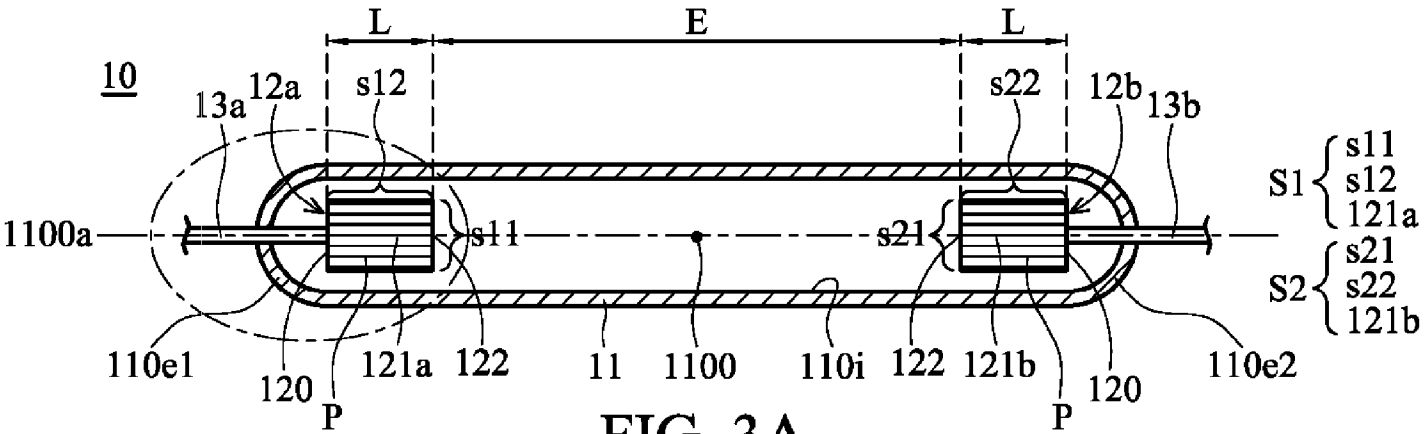
FIG. 3A is a cross-section of a light source of an embodiment of the present invention.

FIG. 3A is a cross-section of a light source 10 of a first embodiment of the present invention. The light source 10 comprises a hollow glass tube 11 having an inner surface 110*i*, a first end 110*e*1 and a second end 110*e*2, a first cylindrical electrode 12*a* with a length L, a second cylindrical electrode 12*b* with a length L, and two wires 13*a* and 13*b*. An effective illumination region with a length E is formed between the first cylindrical electrode 12*a* and second cylindrical electrode 12*b*. The first cylindrical electrode 12*a* is positive, and the second cylindrical electrode 12*b* is negative. The first and second cylindrical electrodes 12*a* and 12*b* are disposed in the hollow glass tube 11 at each end 110*e*1 and 110*e*2 thereof, respectively. The first cylindrical electrode 12*a* comprises a first pillar S1 with a first side (short side) s11, a second side (long side) s12 and a pair of outer/inner first bent surfaces 121*a*/121*ai*, wherein the outer first bent surface 121*a* and the inner first bent surface 121*ai* substantially have the same geometrical configuration and patterns. i.e. the outer first bent surface 121*a* is substantially equal to the inner first bent surface 121*ai*. The second cylindrical electrode 12*b* comprises a second pillar S2 with a first side (short side) s21, a second side (long side) s22 and a second bent surface 121*b*. The second side (long side) s12 of the first cylindrical electrode 12*a* and the second side (long side) s22 of the second cylindrical electrode 12*b* are parallel to a longitudinal direction 1100*a* of the hollow glass tube 11. The first and second cylindrical electrodes 12*a* and 12*b* comprise a peak line P. The peak line P and the hollow glass tube stretch in the same direction. The wires 13*a* and 13*b*, electrically connected to the first cylindrical electrode 12*a* and the second cylindrical electrode 12*b*, are connected to each end (i.e., the first end 110*e*1 and the second end 110*e*2) of the hollow glass tube 11, respectively. The hollow glass tube 11 contains mercury (Hg), inert gas, and phosphor, disposed on an inner wall thereof. The inert gas comprises helium (He), neon (Ne), argon (Ar), krypton (Kr), xenon (Xe), radon (Rn), or a combination of at least two inert gases.

The negative cylindrical electrode 12*b* is disposed at one end (second end 110*e*1) of and sDatially sDaced from the inner surface 110*i* of the hollow glass tube 11. Electrons emitted from the bent surface 121*b* and accelerated due to high voltage, collide with the ions of inert gas and mercury atoms in the hollow glass tube 11, thereby producing UV light. The positive cylindrical electrode 12*a* is disposed at the other end of the hollow glass tube 11. A portion of gaseous ions are sputtered on the outer first bent surface 121*a*.

Figure 3B:
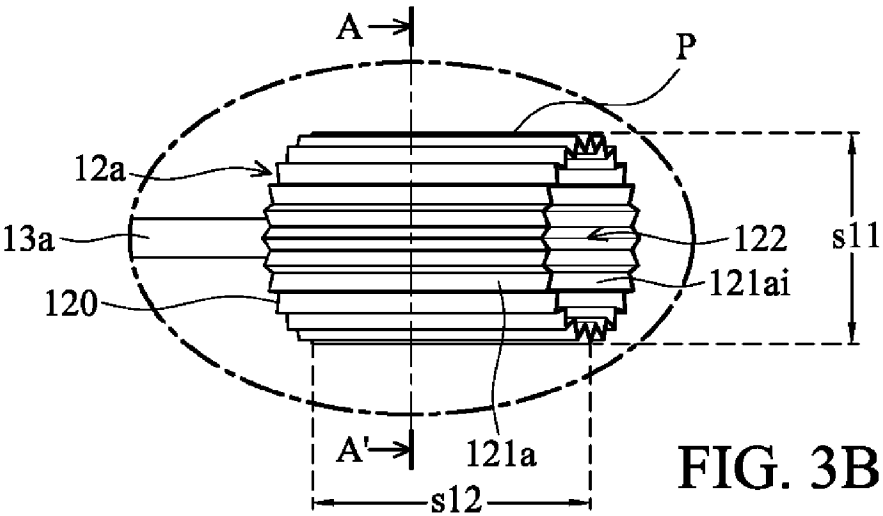
FIG. 3B is a local enlarged view of a first cylindrical electrode of a light source of an embodiment of the present invention.

FIG. 3B is a local enlarged view of the first cylindrical electrode 12*a* of the light source 10 of an embodiment of the present invention. As shown in FIGS. 3A and 3B, the first cylindrical electrode 12*a* is substantially cup-shaped, comprising an opening portion 122 and a closed portion 120. The outer first bent surface 121*a* is connected to the closed portion 120, and the opening portion 122 faces to a central portion 1100 of the hollow glass tube 11.

The first cylindrical electrode 12*a* and the second cylindrical electrode 12*b* can be formed by metal-powder metallurgy or sheet-metal work. Thus, manufacturing costs are reduced. By modifying the shape of the cylindrical electrodes, the electrode is not lengthened, and can moreover, is shortened while providing greater effective light emission region E.

Figures 4A, 4B, 4C:
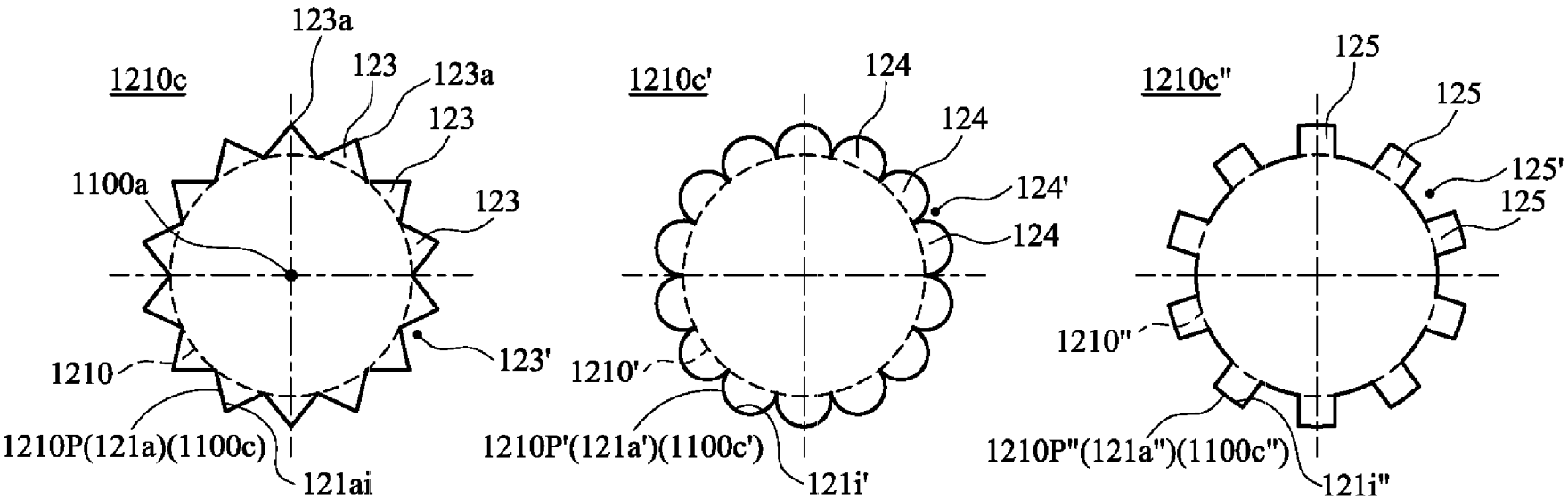
FIG. 4A is a cross-section of a bent surface viewed from line AA' of FIG. 3B.
FIG. 4B is a cross-section of another bent surface viewed from line AA' of FIG. 3B.
FIG. 4C is a cross-section of yet another bent surface viewed from line AA' of FIG. 3B.

In detail, for example, the outer first bent surface 121*a* of the first cylindrical electrode 12*a* is substantially castellated-shaped or substantially ragged-shaped. FIG. 4A is a transverse cross-section 1210*c* geometrically formed by the outer/inner first bent surfaces 121*a* and 112*ai* of the first cylindrical electrode 12*a* viewed from line AA' of FIG. 3B. Referring also to FIGS. 3A and 3B, the first cylindrical electrode 12*a* is provided with a plurality of cross-sections 1210*c* taken along a direction substantially parallel to the short side s11 (i.e., line AA'), or taken along another direction substantially perpendicular to the long side s12 thereof, each of the plurality of cross-sections 1210*c* comprises a bent profile 1210*p* formed with respect to a base circle 1210, and the bent profiles 1210*p* of any two of the plurality of cross-sections 1210*c* are proportioned (except the closed portion 120). That is, the bent profiles 1210*p* of the plurality of cross-sections 1210*c* form the outer first bent surface 121*a*. In the described embodiments, any two of the plurality of cross-sections of the first or second cylindrical electrodes proportionally have the same structure. The bent profile 1210*p* of the cross-section 1210*c* of the outer first bent surface 121*a* of the first cylindrical electrode 12*a* comprises a plurality of connected protruded portions (protrusions) 123 and recessed portions (recesses) 123' alternatively and annularly arranged along the annular circumference 1100*c* with respect to the base circle 1210, each of the connected protrusions 123 comprising a tip-end 123*a*. That is, the protrusions 123 are concaves and the recesses 123' are convexes with respect to the base circle 1210, and the bent profile 1210*p* of the cross-section 1210*c* of the first cylindrical electrode 12*a* is substantially non-circular.

The present invention is not limited to the above example. In some embodiments, only the negative cylindrical electrode 12*b* has a bent surface 121*b*, and the positive cylindrical electrode 12*a* has smooth surface. As long as one of the cylindrical electrodes has a bent surface, since the area of the electron-emitting end is increased, the cylindrical electrode can release more electrons such that more UV light is produced. Thus, light emission efficiency is improved. Alternatively, if only the positive cylindrical electrode 12*a* has a outer first bent surface 121*a*, since the surface area is also increased, sputtering area is increased, and thus, the sputtering time is longer. The lifetime of the light source is extended, and temperature of the cylindrical electrode is reduced accordingly.

The present invention further has variations. In some embodiments of the present invention, as shown in FIG. 4B, a cross-section 1210*c*' of a pair of outer/inner bent surfaces 121' and 121*i*' of a first cylindrical electrode of a second embodiment is shown. Each of the plurality of cross-sections 1210*c*' comprises a bent profile 1210*p*' formed with respect to a base circle 1210', and the outer bent surface 121' can be substantially wave-shaped or substantially concavo-convex-shaped, and comprise a plurality of connected curved (protruded) portions 124 and recessed portions 124' which are alternatively and annularly arranged along the annular circumference 1100*c*' thereof.

In another variation of the present invention, as shown in FIG. 4C, a cross-section 1210*c*" of a pair of outer/inner bent surface 121" and 121*i*" of a first cylindrical electrode of a third embodiment is shown. Each of the plurality of cross-sections 1210*c*" comprises a bent profile 1210*p*" formed with respect to a base circle 1210", and the outer bent surface 121" is substantially bellow-shaped or substantially tooth-shaped, and comprises a plurality of connected protruded portions (protrusions) 125 and recessed portions 125' which are alternatively and annularly arranged along the annular circumference 1100*c*" thereof.

Hence, by varying the shape of the cylindrical electrode, the surface area of the cylindrical electrode is increased radially, and light emission efficiency of the lamp is increased accordingly, while reducing electrode temperature and increasing lifetime of the lamp and cylindrical electrodes.

While the present invention has been described by way of example and in terms of preferred embodiment, it is to be understood that the present invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light source, comprising:

a hollow glass tube; and a cylindrical electrode disposed at one end of and spatially spaced from the hollow glass tube, comprising a circumference and a first bent surface comprising a plurality of connected protruded portions and recessed portions which are alternatively arranged along the circumference, wherein the cylindrical electrode is provided with a plurality of cross-sections taken along a longitudinal direction of the cylindrical electrode, each of the plurality of cross-sections comprises a bent profile, the bent profiles of any two of the plurality of cross-sections are proportioned, and the bent profiles of the plurality of cross-sections form the first bent surface.

2. The light source of claim 1, wherein the first bent surface of the cylindrical electrode is substantially wave-shaped, substantially concavo-convex shaped, substantially bellow-shaped, substantially castellated-shaped, substantially ragged-shaped, or substantially tooth-shaped.

3. The light source of claim 1, wherein the first bent surface of the cylindrical electrode comprises a plurality of connected protrusions, each of the connected protrusions comprising a tip-end.

4. The light source of claim 1, wherein the hollow glass tube comprises a central portion, and the cylindrical electrode further comprises a closed portion opposite to the central portion of the hollow glass tube and is substantially cup-shaped.

5. The light source of claim 4, further comprising a wire electrically connected to the closed portion of the cylindrical electrode and the hollow glass tube.

6. The light source of claim 1, wherein the cross-section of the cylindrical electrode is substantially non-circular.

7. The light source of claim 1, further comprising a negative electrode having a second bent surface equal to the first bent surface of the cylindrical electrode, wherein the negative electrode is disposed opposite to the cylindrical electrode.

8. The light source of claim 1, wherein the cylindrical electrode is formed by metal-powder metallurgy or sheet-metal work.

9. The light source of claim 1, further comprising a frame being adapted to accommodate the light source so as to form a backlight module.

10. A light source, comprising:

a hollow glass tube; and a cylindrical electrode disposed at one end of and spatially spaced from the hollow glass tube, comprising a first side, a second side greater than the first side and longitudinally parallel to the hollow glass tube, a circumference, and a first bent surface comprising a plurality of connected protruded portions and recessed portions which are alternatively arranged along the circumference, wherein the cylindrical electrode is provided with a plurality of cross-sections taken along a direction substantially perpendicular to the second side, each of the plurality of cross-sections comprises a bent profile formed with respect to a base circle, the bent profiles of any two of the plurality of cross-sections are proportioned, and the bent profiles of the plurality of cross-sections form the first bent surface.

11. The light source of claim 10, further comprising a wire electrically connected to the cylindrical electrode and the hollow glass tube.

12. The light source of claim 10, further comprising a negative electrode comprising a second bent surface equal to the first bent surface of the cylindrical electrode, wherein the negative electrode is disposed opposite to the cylindrical electrode.

13. The light source of claim 10, further comprising a frame being adapted to accommodate the light source so as to form a backlight module.

14. A light source, comprising:

a hollow glass tube; and a cylindrical electrode disposed at one end of the hollow glass tube, comprising a circumference and a first bent surface comprising a plurality of connected concaves and convexes, which are alternatively arranged along the circumference.

15. The light source of claim 14, wherein the first bent surface of the cylindrical electrode comprises a plurality of connected cured portions and recessed portions which are alternatively arranged along the circumference.

16. The light source of claim 15, further comprising a wire electrically connected to the cylindrical electrode and the hollow glass tube.

17. The light source of claim 14, further comprising a negative electrode comprising a second bent surface equal to the first bent surface of the cylindrical electrode, wherein the negative electrode is disposed opposite to the cylindrical electrode.

18. The light source of claim 14, further comprising a frame being adapted to accommodate the light source so as to form a backlight module.

19. The light source of claim 1, wherein the cylindrical electrode further comprises a transverse cross-section comprising an outer bent surface spatially spaced from the hollow glass tube and an inner bent surface substantially equal to the outer surface, wherein the first bent surface comprises the outer bent surface.

20. The light source of claim 10, wherein the first bent surface of the cylindrical electrode is substantially wave-shaped, substantially concavo-convex shaped, substantially bellow-shaped, substantially castellated-shaped, substantially ragged-shaped, or substantially tooth-shaped.

* * * * *